US005727321A

United States Patent [19]

Lewis

[11] Patent Number: 5,727,321

[45] Date of Patent: Mar. 17, 1998

[54] UTENSIL WITH BOTH SPOON AND STRAW FUNCTIONS

[75] Inventor: Stuart A. Lewis, Syosset, N.Y.

[73] Assignee: High Point Accessories, Inc., New York, N.Y.

[21] Appl. No.: 744,613

[22] Filed: Nov. 6, 1996

[51] Int. Cl.[6] ..... A47J 43/28

[52] U.S. Cl. ..... 30/141; 30/324

[58] Field of Search ..... 30/141, 324, 326–328; 239/33

[56] References Cited

U.S. PATENT DOCUMENTS 1,606,039 11/1926 Norman ..... 30/141

5,038,476 8/1991 McCrea ..... 30/141

*Primary Examiner*—Douglas D. Watts

*Attorney, Agent, or Firm*—Hoffmann & Baron, LLP

[57] ABSTRACT

A combination spoon and straw utensil for consuming a comestible wherein the functions of sucking and spooning are distinct. The straw section features an improved aspiration intake port which is flared and contoured to improve fluid communication with the bottommost surface of a vessel containing a comestible. A barrier, isolating the functions of spooning and sucking, prevents inadvertent flow of a liquid from the spoon cavity into and through the spoon section during the function of spooning.

6 Claims, 3 Drawing Sheets

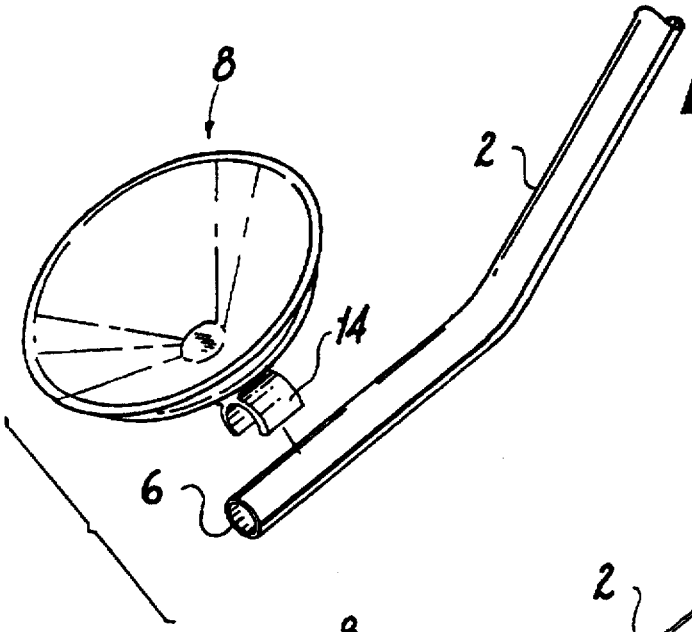
Fig. 5
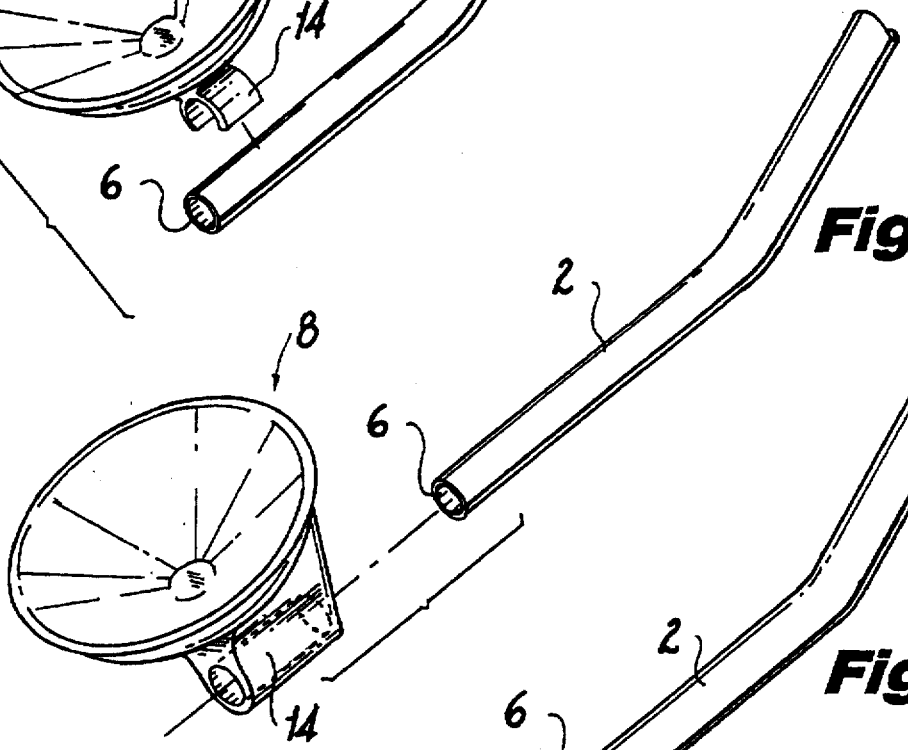
Fig. 6
Fig. 7
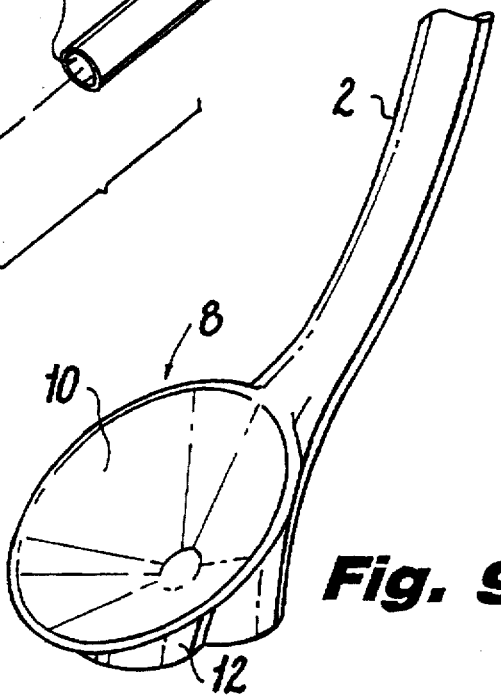
Fig. 9

UTENSIL WITH BOTH SPOON AND STRAW FUNCTIONS

BACKGROUND OF THE INVENTION

The present invention relates generally to eating utensils, and more particularly, to a utensil having both spoon and straw functions.

Certain comestibles, such as ice cream sodas and the like, are most suitably consumed with a utensil that combines the functions of spooning, for transporting solid portions of the food product, and aspirating, for consuming the liquid portion of the comestible. Such spoon and straw combinations have been previously contemplated, however, these designs intermingle the functions of spooning and drinking by providing fluid communication between the two functions.

For example, both U.S. Pat. No. 674,446 to Marx and U.S. Pat. No. DES 259,533 to Frodsham illustrate a spoon/straw combination having a fluid intake orifice of a straw interposed within a bowl of the spoon section. A disadvantage of such a design is the inability to separate spooning and aspirating functions. Thus, fluid may enter the straw section while spooning, and inadvertently pass through the straw, exiting the aspiration port of the straw, resulting in spillage of the fluid. Furthermore, neither the Marx nor Frodsham structures permit aspiration of fluid unless the fluid is capable of being scooped into the bowl of the spoon section.

U.S. Pat. No. DES 290,328 to Imotani also illustrates a spoon and straw combination. The '328 Imotani reference illustrates a spoon cavity attached to a straw member by means of two extension arms from the spoon cavity section. The straw intake orifice is situated above and proximate to the spoon cavity with no barrier to prevent fluid communication between the two operable sections. The device disclosed in the Imotani '328 reference provides fluid communication between a bowl of the spoon section and an intake port of the straw section. Thus, there is no separation of the spooning and aspirating functions. Furthermore, the device disclosed in the '328 Imotani reference has a further disadvantage that the straw intake orifice is necessarily elevated above the bottom of a comestible containing vessel by the height of the spoon cavity section. This prevents the straw intake orifice from effectively communicating with the bottom of the vessel, inhibiting the user of the device from drawing fluid from the bottom portion of the vessel.

U.S. Pat. No. DES 370,587 to Lynch illustrates an ornamental design for a spoon and straw combination. In the Lynch reference the straw section terminates at the base of the spoon cavity and appears to have an intake port at the point of abutment. As with the previous references, the location of the straw orifice allows direct fluid communication between the straw and spoon functions.

The present invention overcomes shortcomings found in the prior an while providing a utensil which combines the functions of drinking and spooning.

SUMMARY OF THE INVENTION

The present invention provides a utensil especially well suited for consuming a comestible having both fluid and solid components. The utensil includes a spoon cavity attached by a junction to a tubular member. The tubular member has the dual functions of providing a drinking tube for consuming a fluid, as well as providing a handle to support the spoon cavity. The spoon cavity is suitable for scooping and transporting the solid portion of the comestible from a vessel to the mouth of the person using the utensil. The junction, which joins the spoon and straw sections, also provides a barrier which prevents fluid communication directly between the two functions.

In one preferred embodiment of the present invention, the junction and spoon cavity are molded as a single piece wherein the junction is formed as a tubular extension projecting from the exterior service of the spoon cavity to receive the tubular member. The tubular member fits within this tubular extension to facilitate attachment. Alternatively, the tubular extension may have an outside diameter selected to fit within the tubular member to facilitate attachment. The junction can be further formed having an aspiration intake port which is flared and contoured to more effectively communicate with a comestible containing vessel. In the presence of aspiration by a consumer at the end of the tube not affixed to the junction, fluids are drawn into the aspiration intake port. The fluids pass through the junction and into and through the rigid tubular member to the mouth of the user.

It will be appreciated by those skilled in the art that a spoon and straw combination formed in accordance with the present invention has the advantage that the functions of spooning and sucking are distinct. This allows a user of the utensil to spoon a food product without the risk of the fluid portion inadvertently entering the straw and leaking out the aspiration end.

A further advantage of the present invention is to be found in the location of the straw intake orifice which provides for an improved interface with the bottom surface of a container. This allows the user of the utensil to fully consume the fluid from the bottommost portion of a comestible-containing vessel. Further, the flared and contoured shape of the opening of the straw section provides a further advantage of an enhanced fluid intake port.

For better understanding of the present invention, together with other and further advantages, reference is made to the following description taken in conjunction with the accompanying drawings, and its scope will be pointed out in the appended claims.

BRIEF DESCRIPTION OF THE DRAWINGS

FIGS. 5, 6, 7 and 9 are perspective views of alternate embodiments of a utensil in accordance with the present invention;

DETAILED DESCRIPTION OF THE INVENTION

Figure 1:
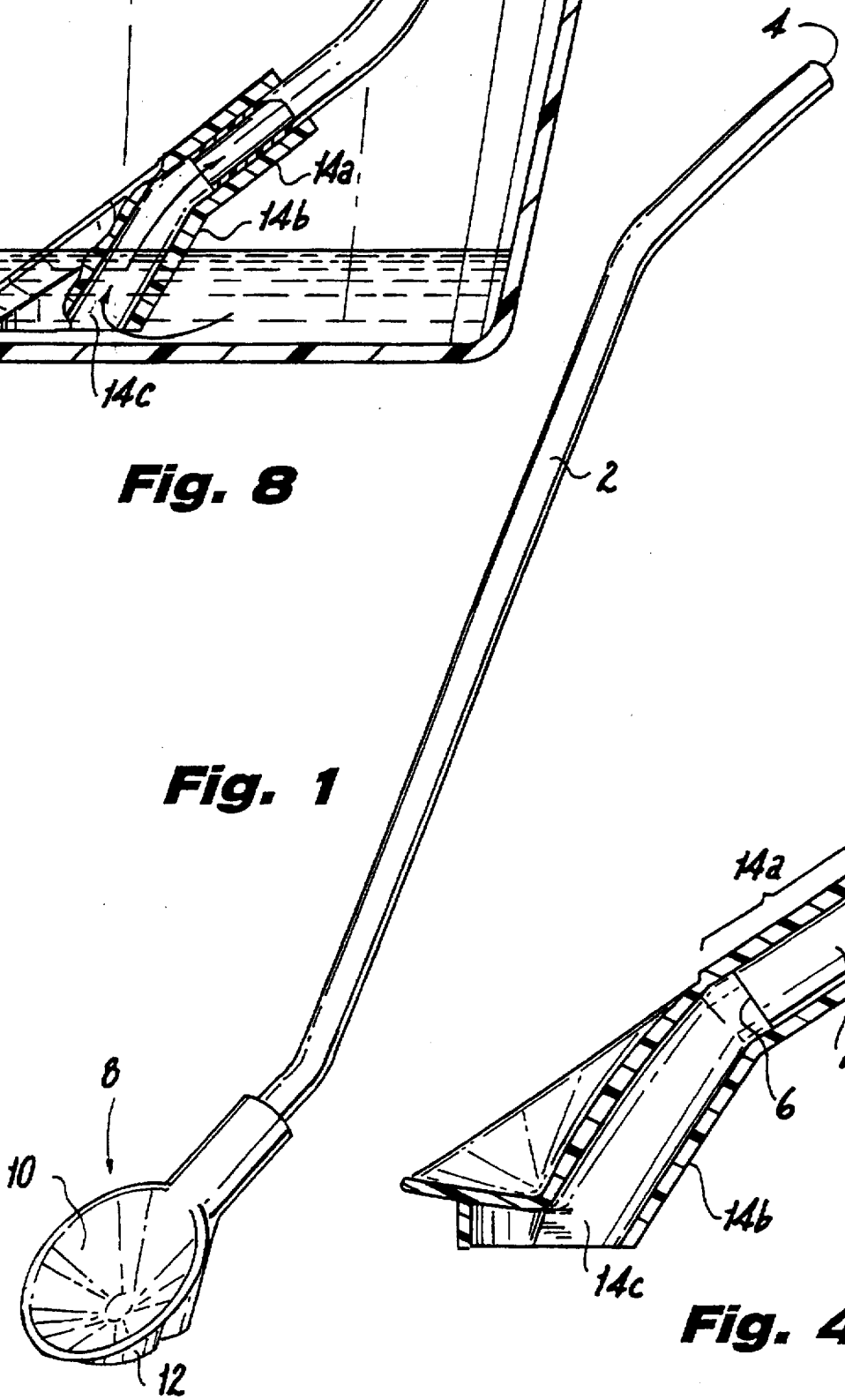
FIG. 1 is a perspective view of the utensil formed in accordance with the present invention.

Referring to the drawings, FIG. 1 shows a perspective view of the utensil of the present invention. The utensil includes a straw section formed from a tubular member 2 having an aspiration port 4 and a fluid intake port 6. The utensil further includes a spoon cavity 8. Since the member 2 must transport the spoon cavity 8 and its contents and be capable of supporting the spoon cavity 8 during scooping and "food excavation" the tubular member 2 is sufficiently rigid to support the spoon cavity 8 carrying out each of these functions.

The spoon cavity 8 is formed from a continuous wall having a concave interior surface 10 and an exterior surface 12. The spoon cavity 8 is affixed to the tubular member 2 by a junction 14. The junction 14 may take on several forms, as will be discussed in further detail, from simple bonding to a molded chamber. However, the junction 14 is always formed such that the fluid intake port 6 of the straw section is isolated from the interior surface 10 of spoon cavity 8. This prevents fluid communication directly between the spoon cavity 8 and the rigid tubular member 2, thereby providing for distinct functions of spooning and aspirating (sucking).

Figure 3:
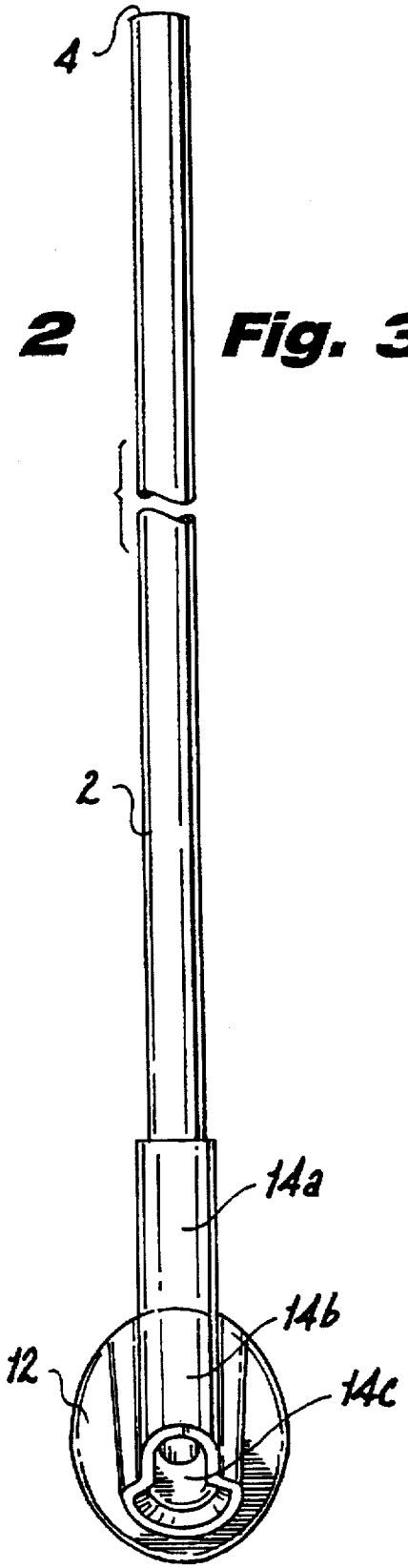
FIG. 3 is a bottom plan view of a utensil formed in accordance with the present invention.

FIG. 3 is a bottom plan view further illustrating a preferred embodiment of a utensil of the present invention. From this view, junction 14 is further shown as having three components. The partial cut away view taken from FIG. 4, line 4—4, shows these features in further detail. The first component of junction 14 is a neck 14A which comprises a tubular extension having a tubular inside diameter sized and shaped to receive and form a friction fit with the rigid tubular member 2. The junction 14 also includes a chamber 14*b* which is formed by a continuous wall extending from the exterior surface 12 of the spoon cavity 8. The final element of the junction 14 is the junction intake orifice 14*c*. The junction intake orifice 14*c* is an opening, which in this embodiment, communicates with the comestible containing vessel. This orifice 14*c* is in fluid communication with straw intake orifice 6 via the chamber 14*b*.

Figure 4:
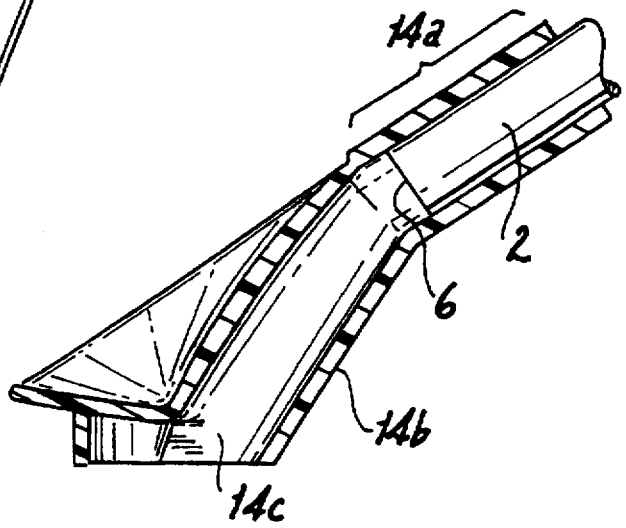
FIG. 4 is a cross sectional view of a first embodiment of a utensil formed in accordance with the present invention.
Figure 2:
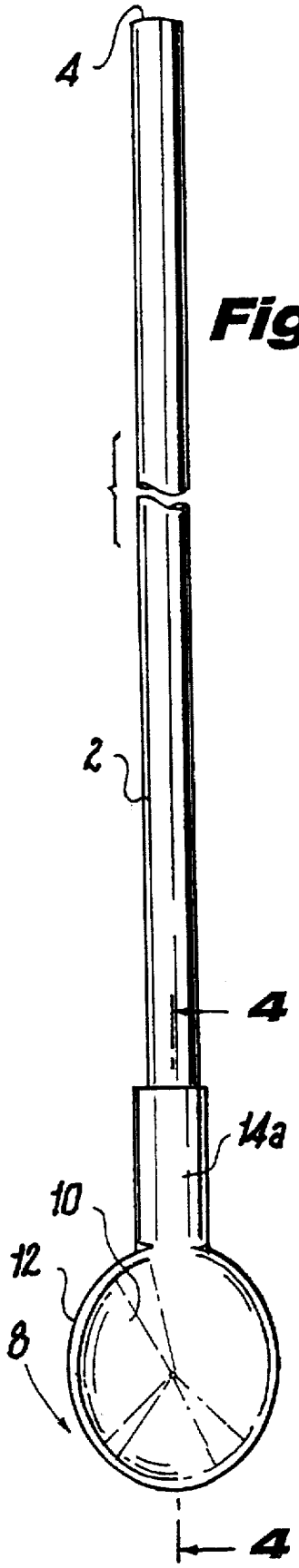
FIG. 2 is a top plan view of a utensil formed in accordance with the present invention.

FIG. 5 shows the simplest embodiment of the present invention wherein the junction 14 between the spoon cavity 8 and rigid tubular member 2 is a simple adhesive joint. The tubular member 2 is tangentially joined to the spoon cavity exterior surface 12 such that a unitary utensil is formed. In this embodiment, fluids are drawn directly into the straw intake orifice 6 and the two operable functions are isolated by the tubular wall of the straw section and continuous exterior surface 12 of the spoon cavity. In FIG. 4, a "C" shaped wall is shown on the exterior surface 12 to facilitate alignment of the straw and spoon sections during bonding, however, this feature is optional.

In the alternate embodiment illustrated in FIG. 6, the junction 14 is formed as a unitary assembly with the spoon cavity 8. The junction 14 is formed from a secondary wall forming a tubular collar along the exterior surface of the spoon cavity. The resulting collar of junction 14 has an interior diameter selected to receive and frictionally hold the tubular member 2. In this embodiment, the exterior surface 12 provides the desired barrier between the spoon cavity 8 and fluid intake port 6.

Another preferred embodiment of the present invention is illustrated in FIG. 7. The junction 14 in this embodiment has a flared and angled intake port 14*c* to communicate with the bottom surface of a typical comestible containing vessel much like that shown in FIG. 4. This shape extends the opening size and is angled to fit cooperatively with the bottom surface of a vessel to enhance fluid communication with the vessel. Further, the junction 14 is formed having the junction neck 14*a* along the same axis as the tubular member such that the spoon cavity and rigid tubular member are essentially on the same axis at the point of connection. FIG. 7 further shows an alternate embodiment of the junction neck 14*a*, which in this embodiment is formed as a tubular member having an exterior diameter preferably selected to frictionally fit within the intake orifice 6 of the straw section. The spoon cavity is attached to the straw section by inserting the neck 14*c* into the intake orifice 6. The attachment may be enhanced by use of an adhesive on the mating surfaces to supplement or substitute for the holding force of the preferred friction fit.

Figure 8:
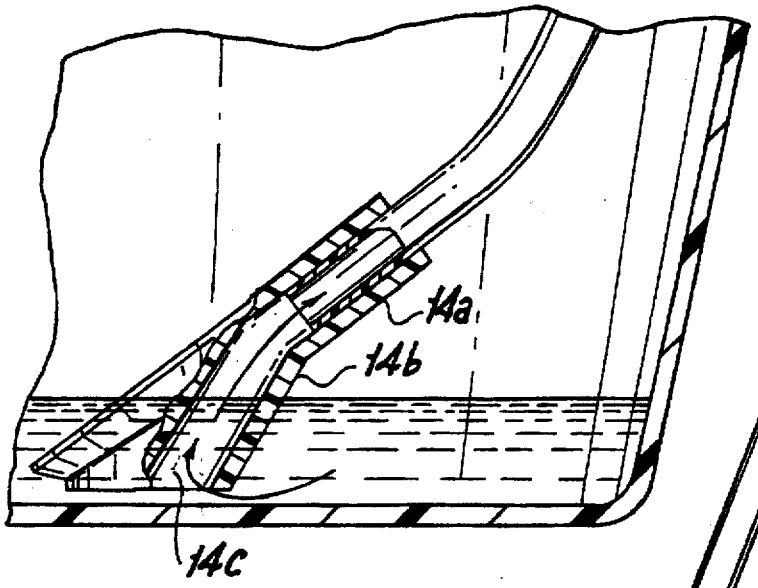
FIG. 8 is a cross sectional view of a preferred embodiment of the present invention shown in communication with a typical comestible container.

FIG. 8 illustrates a utensil of the present invention in cooperation with a comestible containing vessel. This view illustrates the improved fluid interface achieved by the angled and contoured junction intake orifice 14*c*.

It is to be appreciated that while the two piece construction as described is preferred, it is also contemplated that a utensil in accordance with the present invention may be formed as a single part. In this embodiment, shown in FIG. 9, the previously described features would be achieved by suitably forming a mold to fabricate the piece as a unitary structure.

While them have been described what are presently believed to be the preferred embodiments of the invention, those skilled in the art will realize that various changes and modifications may be made to the invention without departing from the spirit of the invention, and it is intended to claim all such changes and modifications as forward in the scope of the invention.

What is claimed:

1. A utensil for use in consuming a comestible comprising:

a rigid tubular member, the tubular member having a length and a first and second end associated therewith, the first and second ends terminating in first and second openings respectively, whereby fluids may pass through the tubular member from said first end to said second end in the presence of aspiration by a consumer;

a spoon cavity formed by a continuous concave wall having an exterior surface and an interior surface for spooning a comestible;

a second wall, said second wall extending from said exterior surface of said spoon cavity, said second wall and exterior surface forming a junction chamber having a first opening, for mating with said rigid tubular member and a second opening in fluid communication with said first opening whereby fluids may pass through said junction in the presence of said aspiration, said junction being extended such that said second opening mates with a bottom surface of a vessel whereby fluids may be drawn from the bottommost surface of said vessel in the presence of aspiration from a user.

2. The utensil of claim 1, wherein said second junction chamber opening is flared and angled to provide said mating between said opening and said vessel.

3. The utensil of claim 1, wherein said junction chamber is formed as a substantially cylindrical collar, said collar having an exterior diameter selected to be substantially equal to an interior diameter of one of said first and second openings of said rigid tubular member, whereby said fixed attachment is provided by a cooperative fit between said collar inserted within said tubular member.

4. The utensil of claim 3, wherein said second junction chamber opening is extended to mate with a bottom surface of a vessel whereby fluids may be drawn from the bottommost surface of said vessel in the presence of aspiration from a user.

5. The utensil of claim 3, wherein said second junction chamber opening is flared and angled to provide said mating between said opening and said vessel.

6. The utensil of claim 1 wherein said rigid tubular member, said spoon cavity, and said junction are formed as a unitary molded structure.

* * * * *